US005430433A

United States Patent [19]

Shima

[11] Patent Number: 5,430,433

[45] Date of Patent: Jul. 4, 1995

[54] RADIO ANALOG SENSOR

[75] Inventor: Hiroshi Shima, Tokyo, Japan

[73] Assignee: Hochiki Kabushiki Kaisha, Tokyo, Japan

[21] Appl. No.: 967,170

[22] Filed: Oct. 27, 1992

[30] Foreign Application Priority Data

Nov. 1, 1991 [JP] Japan ..... 3-286975

[51] Int. Cl.[6] ..... G08B 1/08

[52] U.S. Cl. ..... 340/539; 340/531; 340/588; 340/870.17; 340/870.21

[58] Field of Search ..... 340/539, 531, 511, 588, 340/589, 628, 870.16, 870.17, 870.21; 455/67.2, 34.1, 34.2, 38.3

[56] References Cited

U.S. PATENT DOCUMENTS 4,101,872 7/1978 Pappas ..... 340/539
4,168,494 9/1979 Hummel et al. ..... 340/539
4,785,283 11/1988 Yuchi ..... 340/588
5,128,653 7/1992 Yuchi ..... 340/588
5,148,148 9/1992 Shima et al. ..... 340/539
5,151,683 9/1992 Takahashi et al. ..... 340/588
5,168,262 12/1992 Okayama ..... 340/588

*Primary Examiner*—Donnie L. Crosland
*Attorney, Agent, or Firm*—Max Fogiel

[57] ABSTRACT

A radio analog sensor for transmitting analog signals of a temperature or smoke density to a remote place by radio is used as each of sub devices 12-1 to 12-n. When a change of the analog detection signals of a temperature, a smoke density or the like, which is detected by the analog sensor 10 connected to each of the sub devices, is greater than a predetermined value, the analog signals which have been so far stored in a memory are collectively transmitted to the receiver side by radio. Periodic information is also sent from each of the sub devices 12-1 to 12-n once every two hours so as to supervise the state of the sensors. This permits reliable transmission of necessary data to a remote place without decreasing the life of the battery.

5 Claims, 7 Drawing Sheets

RADIO ANALOG SENSOR

BACKGROUND OF THE INVENTION

1. Field of the Invention

The present invention relates to a radio analog sensor which sends, by radio, analog detection signals about a temperature, a smoke density or the like to a remote place. Particularly, the present invention relates to a radio analog sensor in which a threshold value is set on the sensor side, and analog detection signals are sent to the side of a main device when the detected value exceeds a threshold, whereby data can be sent without decreasing the lifetime of a battery.

2. Description of the Related Art

An analog fire alarm system has recently been put into practical use more and more in which analog signals about a temperature, a smoke density or the like, which is detected by an analog sensor, are sent directly to a receiver whlch decides from the received analog signals wether or not a fire starts. In such a fire alarm system, a fire decision software is loaded on the receiver so as to sample the detection output from the analog sensor at predetermined intervals, predict changes of the fire data in the future from the sampled data, and decide that a fire starts when the predicted data satisfies predetermined fire conditions. This facilitates the detection of a fire in an early stage and the prevention of false alarm.

A fire sensor using the above fire decision software is disclosed in Japanese Patent Laid-Open No. 61-233897 filed by the applicant of this invention. Namely, a decision on a fire is made on the basis of the data obtained by the predicting operation using functional approximation. The detection data of the analog sensor is first sampled by a sampling circuit and averaged by a moving average method. A check is then made as to whether or not the newest data obtained by averaging calculation exceeds an operation starting level.

The threshold levels used for decision on a fire include the operation staring level set to a predetermined level greater than stationary changes of the analog data, and the critical level set for making a decision on a fire from the predicted data. If the averaged data exceeds the operation starting level, non-fire protection processing is started. In this non-fire protect processing, for example, when twenty items of data LD1 to LD20 are successively stored in a memory by averaging calculation, if the newest data LD20 exceeds the operation staring level, changes in the four items of data LD17 to LD20, i.e., the slopes Y1, Y2 and Y3, are detected. A check is then made as to whether or not the positive slopes Y2 and Y3 are greater than a specified slope value Yk, and the number N of slopes greater than Yk is counted. If the count number N is 2 or more, it is decided that there is the danger of a fire, and the predicting operation is started by the functional approximation. For example, when there are two slopes Y2 and Y3 greater than the specified slope value Yk, since the data exceeds the operation staring level with the above slope changes, the predicting operation is performed. On the other hand, when there is only one slope greater than Yk, it is decided that the data change is caused by cigarette smoke or the like, the predicting operation by the functional approximation is not performed.

When the data passed through the non-fire protection processing is obtained, the operation of predicting data changes in the future is performed by a quadratic functional approximation. The principle of the predicting operation by the functional approximation is as follows:

A change of a temperature or smoke density with time in a fire is approximated to the following equation:

$$Y=ax^2+bx+c$$

The coefficients a, b and c of the quadratic functional equation are determined by the method of least squares using the twenty items of data LD1 to LD20 which have been obtained at the same time as the start of operation. If the coefficients a, b and c can be calculated by the above method, data changes in the future can be predicted.

A predicted time Tpu of arrival to the critical level is then calculated. The predicted critical level arrival time Tpu can be determined by determining the time tr of arrival of the locus of the data changes in the future, which is presented by the quadratic function obtained by the predicting operation, to the critical level, and subtracting the present time tn from the critical level arrival time tr.

A check is then made as to whether or not the predicted critical level arrival time Tpu is smaller than a predetermined critical time, e.g., 800 seconds. The shorter the predicted critical level arrival time Tpu, the higher the possibility of a fire. When the predicted time Tpu is 800 seconds or less, it is thus decided that a fire starts, and a fire signal is output.

However, such an analog fire alarm system employs a wire method in which a sensor is connected to a signal line from the receiver, as in a conventional fire alarm system. The analog fire alarm system thus has no merit from the viewpoints of the labor for wiring between the receiver and the sensor and the cost.

A radio alarm system has been thus proposed, which has the greatest merit that it can make wiring between the receiver side and the sensor side unnecessary and which is mainly used in a site of construction and the like.

In a current radio alarm system, when a fire is detected by an on-off type fire sensor, a fire detection signal is sent to the main device side by radio, and a fire alarm is displayed. However, as is obvious from the flow of a wire fire alarm system, the need for a radio analog sensor which performs the above-described analog data processing will be certainly produced in the near future.

A conventional system similar to a radio analog sensor of the above type is a data transmitter such as a telemeter or the like.

A telemeter system employs a method of ordinarily transmitting radio waves or transmitting radio waves by polling from a main station in order to send data about the flow of a river, weather conditions or the like. The telemeter system also generally uses a commercial power source.

However, when the radio transmission method in a conventional telemeter system is applied to a radio analog sensor, there are the following problems:

Although transmission in the telemeter system is long-range transmission with a transmission range of as long as several tens km, the transmission range in a fire sensor is generally as short as 1 km or less. The fire sensor thus consumes only little power for transmission and uses a battery power source for obtaining a merit by completely removing wiring.

When a battery power source is used in a fire sensor, the use of the method of a conventional telemeter system in which radio waves are ordinarily transmitted or transmitted by polling from a main device at predetermined intervals has the advantage that data can be obtained on real time, but it has the problem that the life time of the battery is significantly decreased. This causes the need for frequent change of the battery and makes the maintenance and control troublesome. The fire sensor system cannot be thus put into practical use if no improvement is made.

SUMMARY OF THE INVENTION

The present invention has been achieved in consideration of the above problems of a conventional fire sensor system, and an object of the present invention is to provide a radio analog sensor which is capable of reliably transmitting required data to a distant place.

In order to achieve the object, a radio analog sensor of the present invention is configured as described below.

The radio analog sensor is described below with reference to the drawings.

The radio analog sensor of the present invention comprises a battery power source 25, an analog sensor 10 for detecting a smoke density or a temperature, a storage memory 38 for sampling the analog signals output from the analog sensor 10 at predetermined intervals and storing the sampled signals, and a data processing section 21 for transmitting the stored analog signals to a remote place when a change condition greater than a predetermined value is obtained from the analog signals stored in the storage memory 38.

When the analog sensor 10 detects a temperature, the data processing section 21 transmits the analog signals stored in the storage memory 38 when a rate of change of the present detected temperature from the preceding detected temperature with time is greater than a predetermined value.

When the analog sensor detects a smoke density, the data processing section 21 transmits the analog signals stored in the storage memory 38 when the integral value of the analog signals exceeds a predetermined value.

The radio analog sensor of the present invention also comprises a periodic information circuit 36 for transmitting predetermined periodic information at constant time intervals.

The radio analog sensor of the present invention further comprises a transmission control section 20 for detecting whether or not a carrier of the frequency channel first selected from a plurality of frequency channels which have previously been assigned is received. When no carrier is detected, the first selected frequency channel is used for transmission. While when a carrier is detected, the frequency channel is switched until the carrier is detected, and a free channel in which no carrier is detected is selected.

The radio analog sensor of the present invention configured as described above collectively transmits, by radio, the stored analog signals stored so far to the receiver side when a change of the analog signals about the temperature or smoke density, which is detected by the analog sensor, is greater than a predetermined value. Since the frequency with which the conditions of transmission of the stored analog signals are established, i.e., the frequency of occurrence of fires, is very low, the necessary number of transmissions can be minimized, thereby significantly increasing the lifetime of the battery.

In addition, the state of the sensor can be observed by performing periodic information. However, the number of periodic informations is small, for example, once every two hours, and the transmission time is very short because the amount of data to be transmitted by the periodic information is small. The lifetime of the battery can thus be maintained even if the periodic information is performed. Conversely, the state on the sensor side is observed by periodic information, whereby the reliability as a system can be significantly increased.

In addition, since radio waves need not to be ordinarily transmitted, there is no danger of radio interference even if only few channels are assigned to many sensors, thereby increasing the efficiency of use of a frequency.

Further, since the sensor is a radio type and thus requires no wiring work, and since a decision on a fire is made on the transmitter side which transmits analog data, the decision on a fire can be rapidly and accurately made.

DESCRIPTION OF PREFERRED EMBODIMENTS

Figure 1:
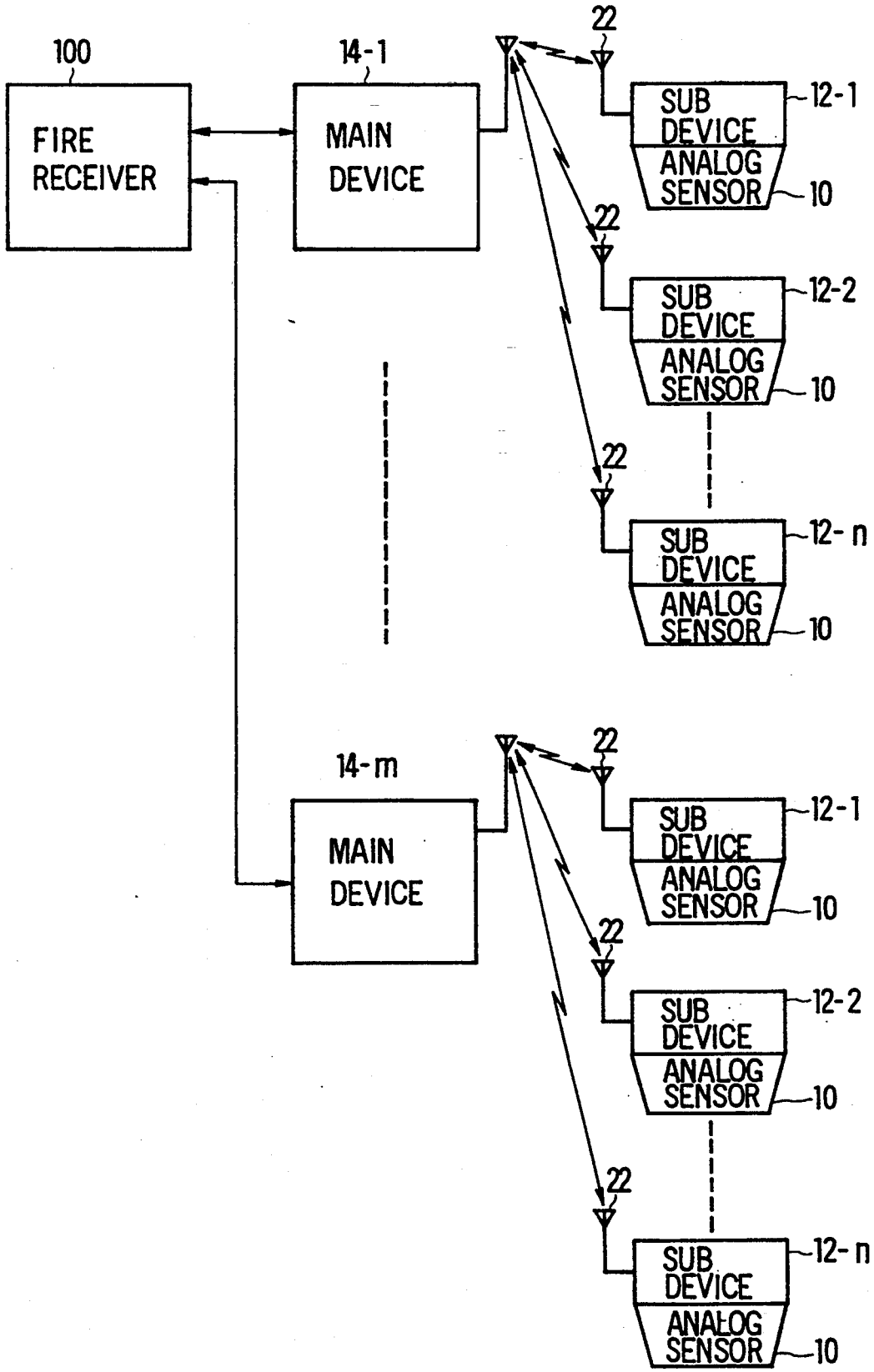
FIG. 1 is a drawing explaining the configuration of an embodiment of a system using a radio analog sensor of the present invention.

FIG. 1 is a drawing explaining the configuration of a system using a radio analog sensor of the present invention.

In FIG. 1, reference numerals 14-1 to 14-m each denote a main device provided on the receiver side. Each of the main devices 14-1 to 14-m holds a plurality of sub devices 12-1 to 12-n each of which serves as a radio analog sensor of the present invention. One main device and a plurality of sub devices form one group.

Analog sensors 10 are respectively connected, integrally or by signal lines, to the sub devices 12-1 to 12-n each of which is used as a radio analog sensor of the present invention. When a change of the analog data output from the analog sensor 10 exceeds a predetermined value, the analog data stored in a storage memory contained in each of the sub devices during a predetermined number of periods before this point of time are converted to predetermined signals and transmitted to the main device 14-1 through an antenna 22.

For example, an analog temperature sensor for detecting a temperature or an analog smoke density sensor for detecting a smoke density is used as each of the analog sensors 10.

For example, six transmission channels CH1 to CH6 with a frequency band of 429 MHz are assigned to the sub devices 12-1 to 12-n. Before transmission, one of the sub devices 12-1 to 12-n first assumes a receiving state where the sub device performs the carrier sense operation of searching for a free channel which is not used by another sub device. If a free channel is selected, the receiving state is switched to a transmission state where the sub device transmits a group of analog data obtained from the storage memory together with a group address and a separate address.

Each of the sub devices 12-1 to 12-n is provided with the function of periodically sending information at predetermined intervals, for example, once every 2 hours. During this periodic information, each of the sub devices performs a periodic information operation of periodically sending predetermined information about the battery, the sensor state and so on together with a group address and a separate address to the main device side.

A group address and separate addresses of a plurality of sub devices which belong to the same group are set in each of the main devices 14-1 to 14-m. In a stationary supervisory state, each of the sub devices 14-1 to 14-m successively repeats the carrier sense operation for the transmission channels CH1 to CH6 which are assigned to the sub device side. When a carrier is detected in a specific channel, each of the main devices 14-1 to 14-m is fixed to the receiving state for receiving the information transmitted from the sub device side.

In processing of the information transmitted from each of the sub devices, the information is first subjected to address collating. Namely, a decision is made as to whether or not the group address and the separate address, which are received from the sub device side, respectively agree with the addresses previously set on the main device side. If it is decided that the group address and the separate address respectively agree with the addressed on the main device side, the received information is read. In the case of a group of analog data, the data are sent to the side of a fire receiver 100 together with the address information. The fire receiver 100 executes fire decision processing by a fire decision software loaded thereon, as described above.

On the other hand, in the case of the periodic information, a timer counter which outputs an abnormal signal of the periodic information is cleared. In the periodic information, if the periodic information is not received due to an abnormality on the sub device side within a predetermined time, the timer counter overflows. It is decided from this overflow that the periodic information is not received within the predetermined time, and an abnormal signal of the periodic information is output. When the periodic information is normally received, therefore, the timer counter is first cleared.

In addition, the main device 14-1 is provided with a fire display. The fire display permits the main device 14-1 which receives an information signal to separately display the occurrence of a fire together with the addresses of the sub device when it is decided by the fire decision processing on the side of the fire receiver 100 that a fire occurs.

Figure 2:
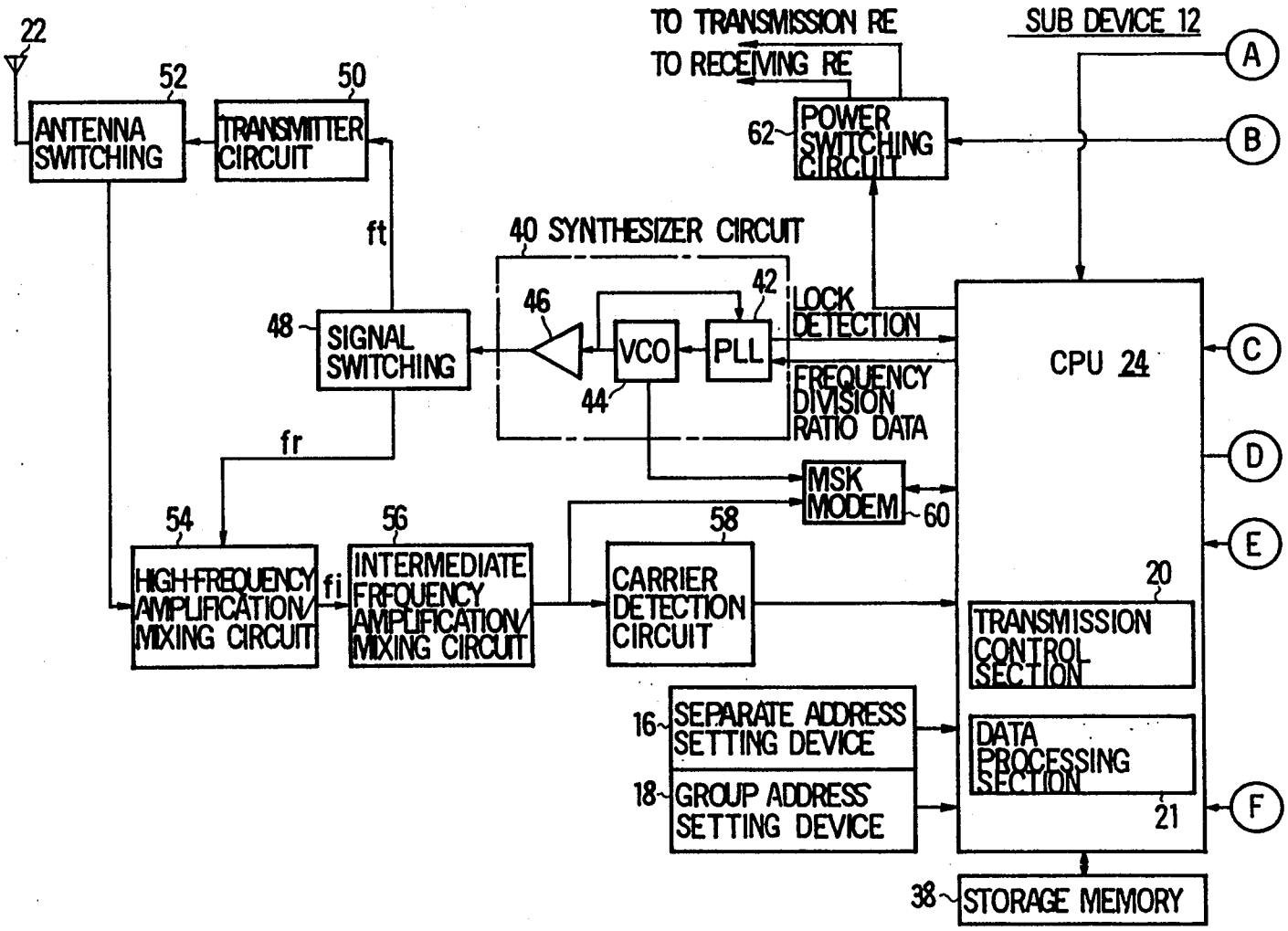
FIG. 2 is a block diagram showing an embodiment of a radio analog sensor of the present invention used as a sub device in the system shown in FIG. 1.
Figure 2:
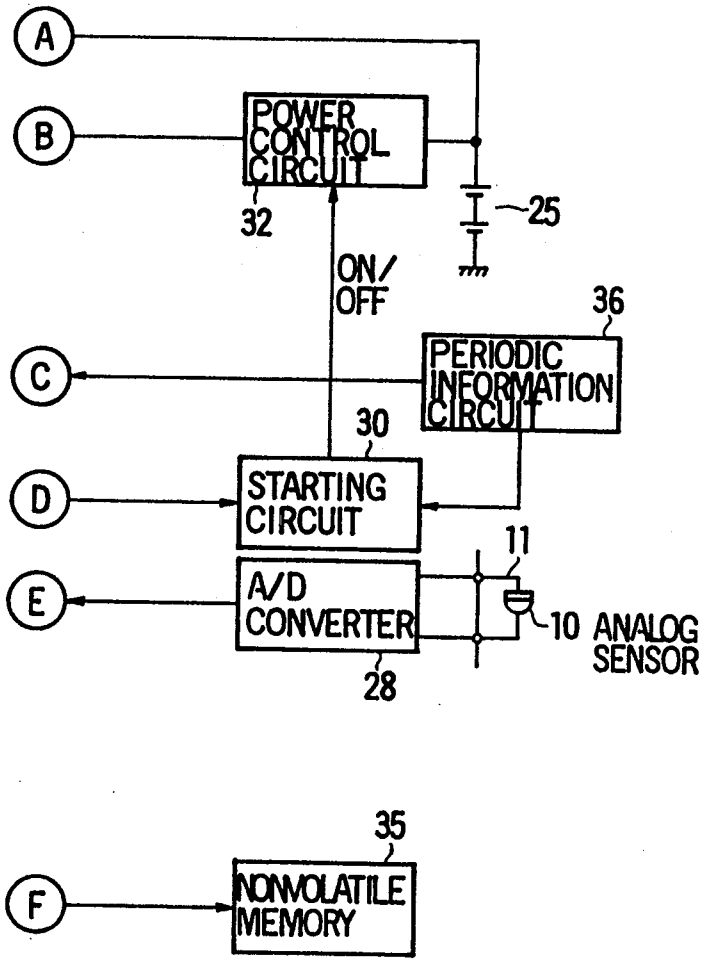

FIG. 2 is a block diagram showing an embodiment of the sub device used as a radio analog sensor in accordance with the present invention.

In FIG. 2, a sub device 12 is provided with a CPU 24. A transmission control section 20 and a data processing section 21 are operated by the program control of the CPU 24. To the CPU 24 are connected a separate address setting device 16 and a group address setting device 18 so as to set group addresses and separate addresses, which are previously assigned. in the CPU 24.

An analog sensor 10 is connected to the input terminal of an A/D converter 28 through a signal line 11. An analog data is converted into digital data by the A/D converter 28 and is then supplied to the CPU 24 hereinafter the digital data is merely called "data".

The signal output from the A/D converter 28 is processed by the data processing section 21 provided in the CPU 24.

The data processing section 21 samples data from the output of the A/D converter 28 at predetermined intervals, for example, intervals of 2 to 3 seconds, and stores the sampled data in a storage memory 38. In the storage memory 38 are stored a predetermined number of data obtained during a predetermined number of periods before this point of time.

The data processing section 21 makes a decision as to whether or not a change of the present data obtained is greater than a predetermined value each time the data output from the A/D converter 28 is sampled and stored in the storage memory 38. When the change is greater than the predetermined value, the transmission control section 20 is started so as to transmit, to the receiving side, a plural number of data stored in the storage memory 38 during a predetermined number of periods before this point of time.

Figure 3:
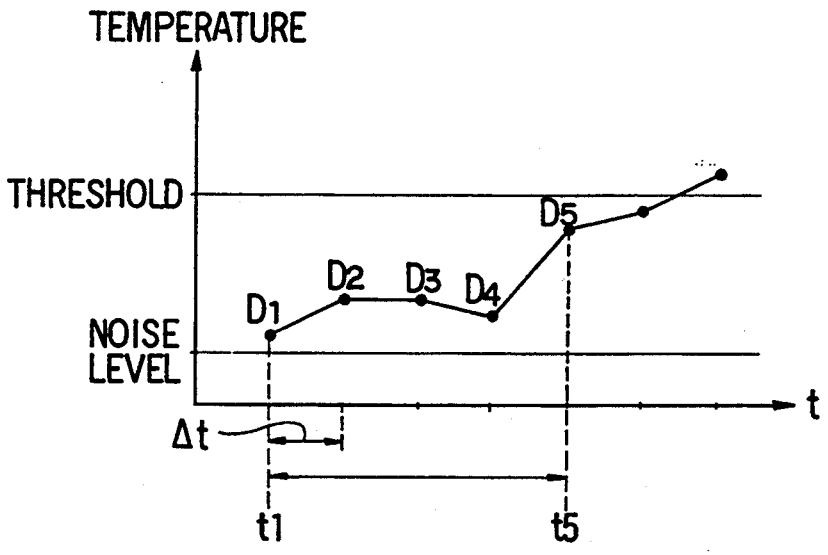
FIG. 3 is a graph showing the characteristics of transmission decision processing of analog temperature signals in the sensor shown in FIG. 2.

FIG. 3 is a drawing explaining the conditions of processing by the data processing section 21 when an analog temperature sensor is used as the analog sensor 10.

In FIG. 3, data D5, D4, D3, D2 and D1 are the data sampled with a period of Dt. In this embodiment, a rate of change of the data with time is determined at every sampling time, and the data is transmitted when the rate of change with time, i.e., the differential value, is greater than a predetermined value.

Namely, assuming that the present data at is Dn, and the preceding data is Dn-1, the rate of change with time is calculated by the following equation:

$$(Dn-Dn\text{-}1)/Dt \qquad (1)$$

In the case shown in FIG. 3, since the differential value at the time t5 calculated by the equation (1) is greater than the predetermined value, the five items of data D5, D4, D3, D2 and D1 stored during four periods before the time t5 are transmitted to the receiving side.

Figure 4:
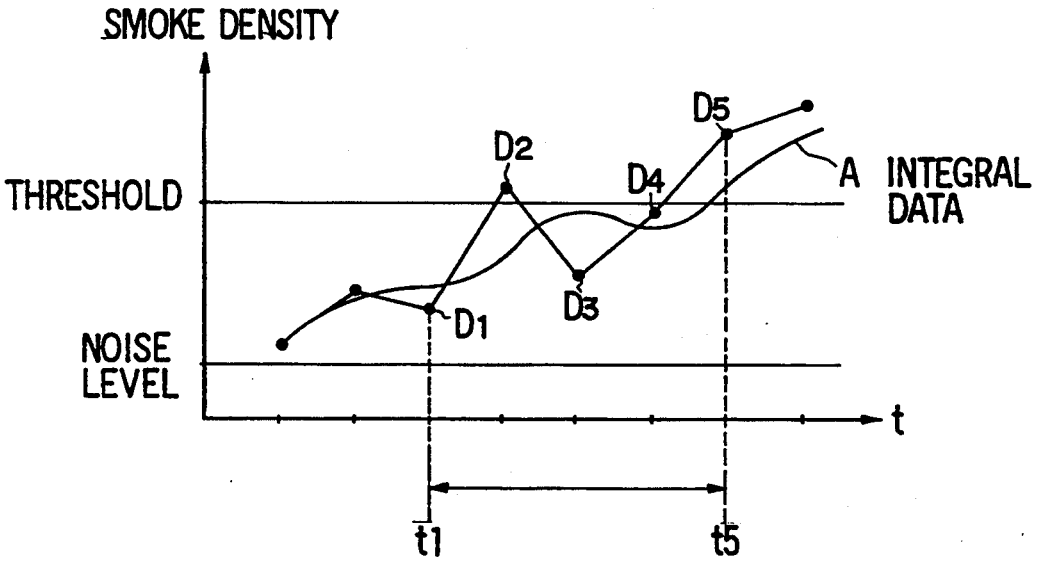
FIG. 4 is a graph showing the characteristics of transmission decision processing of analog smoke density signals in the sensor shown in FIG. 2.

FIG. 4 is a drawing explaining the conditions of processing by the data processing section 21 shown in FIG. 2 when an analog smoke density sensor is used as the analog sensor 10.

In the case of the analog smoke density shown in FIG. 4, the data shown by a polygonal line and sampled with a period of Dt is integrated to obtain the integral data shown by curve A. When the integral data shown by curve A is greater than a predetermined threshold, a plural number of data including the next sampled data and stored during a predetermined number of periods are transmitted.

The reason for integrating the data obtained from the analog smoke density sensor is that since the smoke sensor is easily affected by electrical noise or the like, as compared with the heat sensor, data is processed by integration.

In the case shown in FIG. 4, since the integral data shown by curve A exceeds the threshold immediately before the sampling time tS, five items of data D5 to D1 stored during four periods before the time t5 are transmitted.

In FIGS. 3 and 4, a noise level lower than the threshold is provided so that only data of levels higher than the noise level is stored in the memory and subjected to decision processing.

Figure 5:
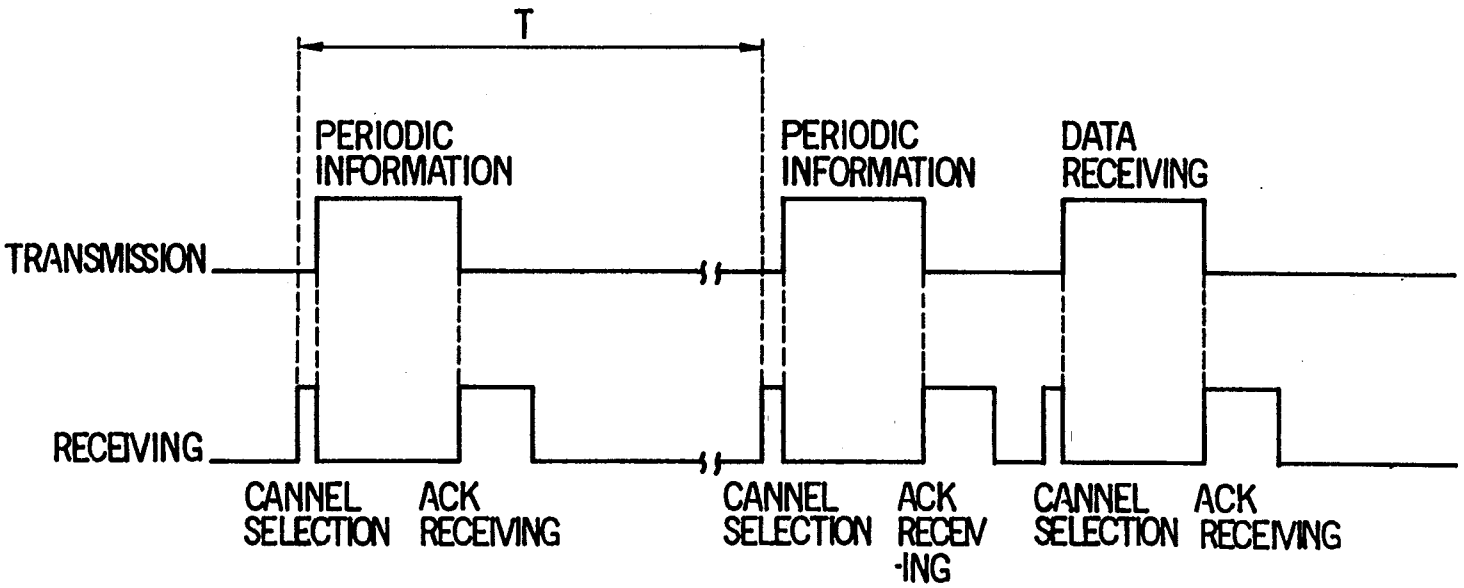
FIG. 5 is a time chart showing the transmitting and receiving operation of the sub device shown in FIG. 2.

FIG. 5 is a time chart showing the transmitting and receiving operation of the transmission control section 20 provided in the CPU 24 of the sub device 12 shown in FIG. 2. The transmitting and receiving operation includes transmission of data by the data processing section 21 and the periodic information by the periodic information circuit 36 connected to the CPU 24.

In FIG. 5, the operation of receiving the channel selection signal and the operation of receiving the periodic information are repeated with a periodic information period T, for example, T=2 hours. When the operation of transmitting the periodic information is performed, the sub device returns to the receiving state. The sub device receives the acknowledge signal, ACK signal, from the side of the main device. If the ACK signal can be normally received, it is decided that the periodic information is normally made. If the ACK signal is not received, the periodic information is retried.

FIG. 5 also shows the operation of sending data immediately after two times of periodic information. Namely, the transmission condition shown in FIG. 3 or 4 is obtained from the data by the data processing section 21, the transmission state is first established for channel selection. When a free channel is selected, the analog data is transmitted. The transmission state returns to the receiving state where the ACK signal is received from the side of the main device. If the ACK signal is not received, data transmission is retried.

Although FIG. 5 shows only one transmission method of the data, in fact, any one of the following three methods is employed. (1) When the condition shown in FIG. 3 or 4 is established, after a plural number of stored data, for example, five items of stored data, are transmitted, the data is sent on real time each time the data is sampled with a period of $\Delta t$. (2) After the stored analog data is transmitted, a decision is made on the basis of the command received from the side of the main device as to whether or not transmission is continued. (3) After, for example, five items of data are transmitted for the first time, when five items of data are stored in the storage memory 38 in the same way, the operation of collectively transmitting the stored data is repeated.

Details of the transmission control function of the transmission control section 20 provided in the CPU 24 are described with reference to FIG. 2.

When the transmission condition is distinguished by the data processing section 21, the CPU 24 outputs a starting signal to a starting circuit 30. The starting circuit 30 operates a power control circuit 32 to start the supply of power to a power switching circuit 62. On the other hand, when it is the periodic information time in the periodic information circuit 36, a starting signal is input to the starting circuit 30. In this case, similarly, the power control circuit 32 is operated to supply power to the power switching circuit 62 from a battery power source 25.

The transmission operation is performed by the transmission control section 20 as described below. Power is first supplied to the receiving RF side by the power switching circuit 62 to establish the receiving state. The carrier sense processing for searching for a free channel in the channels CH1 to CH6 is then carried out. When a free channel is selected by the carrier sense processing, the power switching circuit 62 is switched to the transmission RF side to establish the transmission state. A group of data read from the storage memory 38 or periodic information is then transmitted together with the address information.

A nonvolatile memory 35 is also provided on the CPU 24. In the nonvolatile memory 35 is stored a calling identification code (ID code) which is authorized by the Minister of Posts and Telecommunications and which is inherent to the system. At the start of transmission, the calling identification code of the nonvolatile memory 35 is read and is transmitted in the first stage of the transmission action.

The calling identification code is obligated by the Wireless Telegraphy Act. to be first sent during radio transmission by a specific small power radio station. Another appropriate transmission format can be used for weak radio waves.

On the CPU 24 are provided a receiver section for carrier sense and a transmitter section for transmitting data.

In the transmitter and receiver sections, reference numeral 40 denotes a synthesizer circuit which oscillates the local oscillation frequency fr of one of the channels CH1 to CH6 during the carrier sense operation in the receiving state. On the other hand, the synthesizer circuit 40 oscillates the carrier frequency ft of one of the channels CH1 to CH6 during the transmission action after the carrier sense operation. The synthesizer circuit 40 comprises a PLL circuit 42, VCO (voltage controlled oscillator) 44 and an amplifier 46.

The oscillation frequency of the VCO 44 can be freely changed by setting the frequency division ratio data by the CPU 24. The CPU 24 receives the lock detection signal locked to the oscillation frequency prescribed by the PLL circuit 42 so as to confirm the normal operation.

The output of the synthesizer circuit 40 is supplied to a transmitter circuit 50 or a high-frequency amplification/mixing circuit 54 on the receiving side through a signal switch 48.

The output of the transmitter circuit 50 is supplied to an antenna 22 through an antenna switch 52. The other side of the antenna switch 52 is connected to the input side of the high-frequency amplification/mixing circuit 54. During the carrier sense processing, the high-frequency amplification/mixing circuit 54 receives the local oscillation frequency fr of one of the channels CH1 to CH6 from the synthesizer circuit 40, and converts the frequency of the received signal to output a intermediate frequency fi signal.

Assuming that the carrier frequency ft1 of the channel CH1 is 429.175 MHz, and the intermediate frequency output from the high-frequency amplification/mixing circuit 54 is 21.7 MHz, the local oscillation frequency fr of 407.475 MHz is supplied from the synthesizer circuit 40 during the carrier sense processing of the channel CH1.

A intermediate-frequency amplification/mixing circuit 56 further converts the frequency of the intermediate frequency signal of 21.7 MHz to output a intermediate frequency signal of 455 kHz. This method in which the frequency is converted twice by the high-frequency amplification/mixing circuit 54 and the intermediate-frequency amplification/mixing circuit 56 is known as a double superheterodyne method.

The output of the intermediate-frequency amplification/mixing circuit 56 is supplied to a carrier detection circuit 58 and a MSK modem 60. The carrier detection circuit 58 has a threshold based on a white noise level without carrier. If the output is lower than the threshold, the detection output without carrier is supplied to the CPU 24. On the other hand, if the output exceeds the threshold, the detection output with a carrier is supplied to the CPU 24.

The MSK modem 60 performs modulation and demodulation with data bit 1 corresponding to 1200 Hz and data bit 0 corresponding to 1800 Hz. In other words, the frequency signal received from the side of the main device is demodulated to data bit 1 or 0 by the MSK modem 60 and is then supplied to the CPU 24. The data bit 1 or 0 of the data transmitted from the CPU 24 is converted into a frequency signal of 1200 Hz or 1800 Hz by the MSK modem 60 and is then supplied to the VCO 44 so that the present carrier frequency is subjected to MSK modulation and transmitted.

A power switching circuit 62 switches the transmitting and receiving actions by turning on and off the power supply to the transmitter section and the receiver section under the control by the CPU 24. At the same time, the signal switch 48 and the antenna switch 52 are switched so that the circuit side in an operating state to which electric power is supplied becomes effective.

Figure 6:
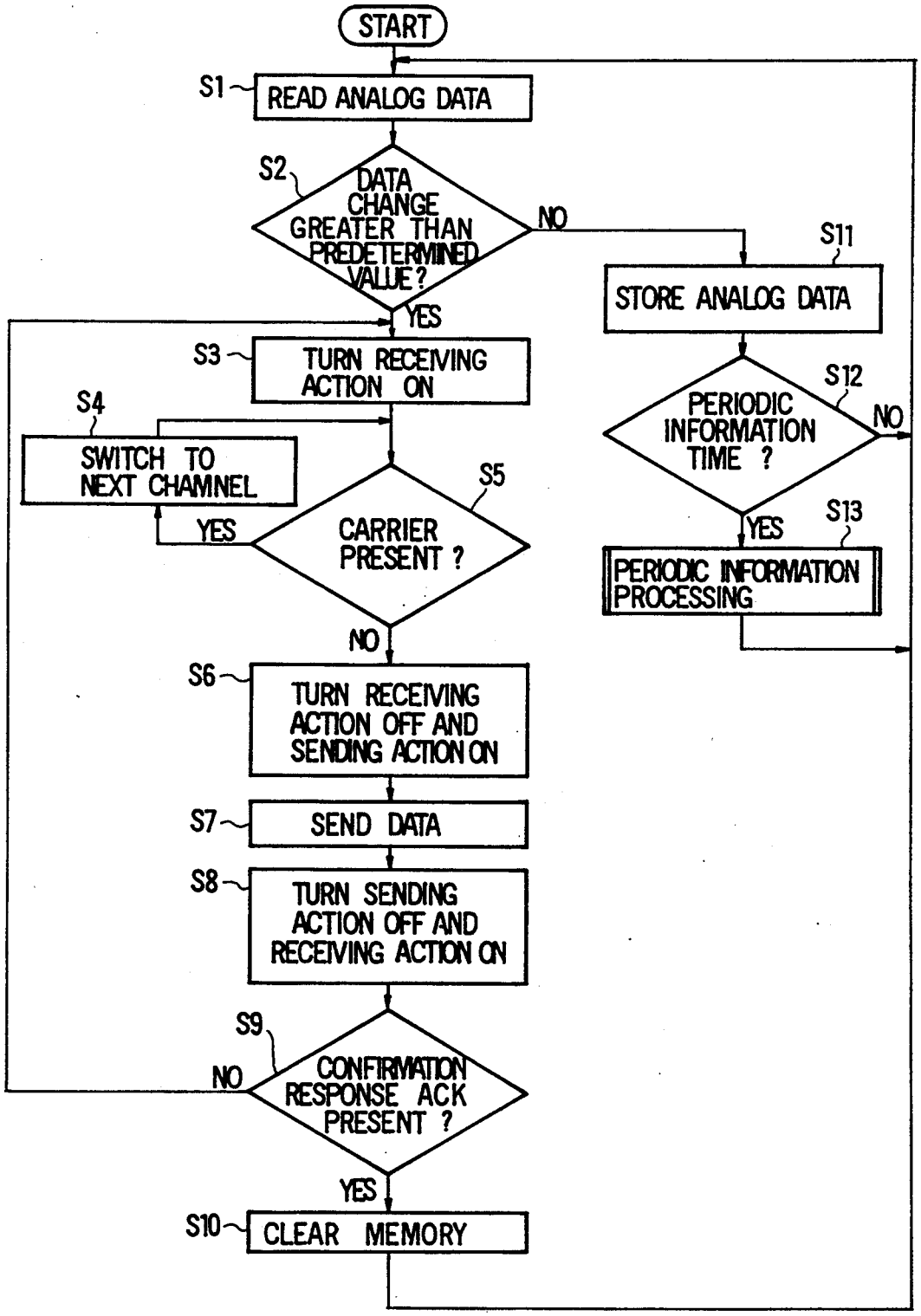
FIG. 6 is a flow chart showing the operation of the radio analog sensor (sub device) shown in FIG. 2.

FIG. 6 is a flow chart showing the operation of the sub device shown in FIG. 2 and used as a radio analog sensor in accordance with the present invention.

In FIG. 6, in Step S1, the analog data from the analog sensor 10 is first read with a sampling period $\Delta t$. In next Step S2, a decision is made as to whether or not a change of the data is greater than a predetermined value. For example, if the analog data is an analog temperature signal, a decision is made as to whether or not the condition shown in FIG. 3 is satisfied. If the data is an analog smoke density signal, a decision is made as to whether or not the condition shown in FIG. 4 is satisfied.

When it is decided in Step S2 that a change of the analog data is greater than the predetermined value, the flow moves to Step S3 in which the receiving action is turned on. The flow then moves to carrier sense processing in Steps S4 and S5.

Namely, the CPU 24 actuates a starting circuit 30 to start a power control circuit 32. This cause a power source to be supplied to the receiver section from a battery power source 25 through a power switching circuit 62 to bring the receiver section into the receiving state. The presence of the output of the carrier detection circuit 58 is checked. If no carrier detection output is obtained, the channel CH1 is selected as a free channel.

On the other hand, if the carrier detection output is obtained, carrier sense processing is performed for the next channel CH2 in Step S5. The carrier sense processing is repeated by switching the channels until it is decided in Step S4 that no carrier is obtained. The carrier sense processing is performed for each of the sub devices with different delay times which are randomly set in order to prevent radio interference even if the transmission condition is simultaneously established in a plurality of sub devices.

When a free channel is selected by the carrier sense processing, the frequency division ratio data is set in the PLL circuit 42 so as to oscillate the carrier frequency of the selected free channel. The flow then moves to Step S6 in which the power switching circuit 62 is switched to supply power to the transmitter section. Namely, the receiving action is turned off, and at the same time, the transmitting action is turned on.

The flow then moves to Step S7 in which a predetermined number of stored analog data read from the storage memory 38 are transmitted. In this transmission of the data, the calling identification code (ID code) inherent to the system is first transmitted. After transmission of the calling identification code is completed, the data is sent. As a matter of course, each item of data is provided with a parity bit, an error collection code or the like in order to control error.

When the transmission of data is completed in Step S7, the power switching circuit 62 is switched to supply power to the receiver section. Namely, the transmitting action is turned off, and at the same time, the receiving action is turned on.

The main device side which receives the data sent in Step S7 sends the ACK signal for acknowledgement if the main device normally receives the data. The presence of the acknowledge ACK signal sent from the main device side is checked in Step S9. If the ACK signal can normally be received, the storage memory 38 which is made unnecessary after the completion of data transmission is cleared in Step S10, and the flow again returns to the initial state in Step S1.

If the ACK signal cannot be obtained in Step S9, the flow moves to Step S3 in which the same data transmission processing as that described above is retried. Since it is useless to perform further retry actions after a predetermined number of retry actions, the processing is interrupted, and it is decided that abnormal end occurs.

The periodic information action is described below. When it is decided in Step S2 that a change of the data is smaller than the predetermined value, the data is stored in the storage memory 38 in Step S11. In Step S12, a decision is made as to whether or not it is the periodic information time. If it is the periodic information time, the flow moves to Step S13 for periodic information processing.

The contents of the periodic information processing in Step S13 are the same as those of the operation of transmitting the data in Steps S3 to S9. In the periodic information processing in Step S13, periodic information is sent in place of the data sent in Step S7.

Figure 7:
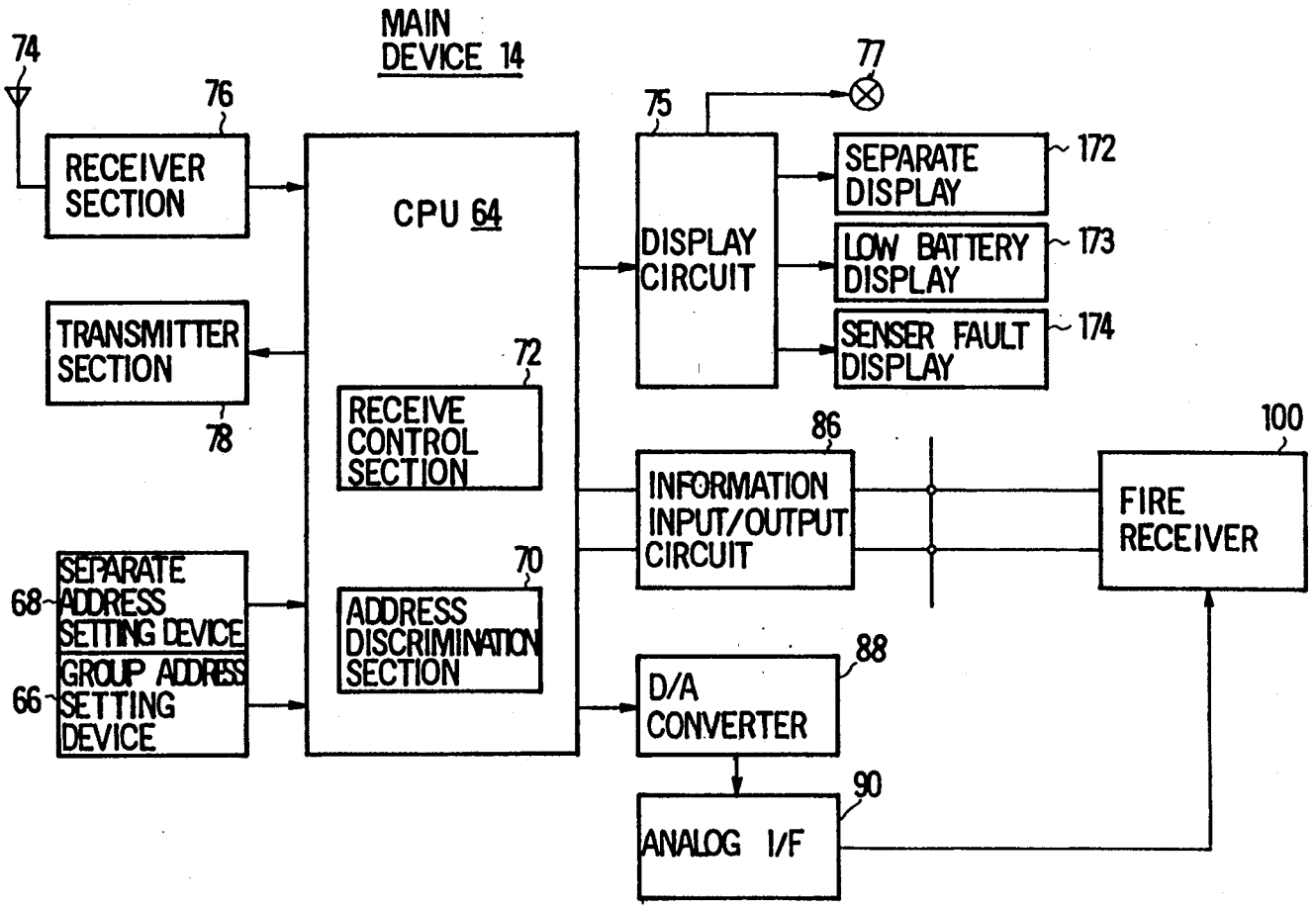
FIG. 7 is a block diagram of an embodiment of the main device shown in FIG. 1.

FIG. 7 is a block diagram showing an embodiment of the main device shown in FIG. 1.

In FIG. 7, a main device 14 is provided with a CPU 64, and an address discrimination section 70 and a receive control section 72 are operated by the program control of the CPU 64.

A group address setting device 66 and a separate address setting device 68 are connected to the CPU 64 so as to set a group address and the separate addresses of a plurality of sub devices which belong to this group.

An antenna 74, a receiver section 76 and a transmitter section 78 are also connected to the CPU 64. The receiver section 76 and the transmitter section 78 are the same as those on the side of the sub device 12 shown in FIG. 2.

A receive control section 72 of the CPU 64 successively repeats carrier sense processing for the channels CH1 to CH6 by switching the frequency division ratio data for successively oscillating the local oscillation frequencies of the channels CH1 to CH6 to the PLL synthesizer circuit provided on the receive control section 76.

If the carrier sense output is obtained from the receive control section 76, the receive control section 76 is fixed to the receiving state for the channel subjected to the carrier sense processing. The receive control section 72 obtains the demodulated received data with data bit 1 or 0 from the signal received in the receiving state. The receive control section 72 which has obtained the received data supplies the group address and separate address, both of which are received, to the address discrimation section 70 for address collating.

If agreement of the addresses is obtained in the address discrimination section 70, the receive control section 72 converts the plural data received together with the address data into, for example, a current signal of 4 to 20 mA, by a D/A converter 88. The current signal is then transmitted to a fire receiver 100 through an analog interface 90 so that a decision on a fire is made by a fire decision software loaded on the fire receiver 100, as described above.

If it is decided by the sub device 14 on side of the fire receiver 100 on the basis of the data that a fire occurs, a fire alarm is sent, and at the same time, the fire detection information is supplied to an information input/output circuit 86 together with the addresses. The CPU 64 drives a display circuit 75 to light a fire display lamp 77, and the address of the sub device which detects a fire is displayed on a separate display 172.

On the other hand, when the receive control section 72 discriminately judges that the periodic information is received, the periodic information timer counter contained in the CPU 64 is cleared. If the periodic information involves low battery information, the display circuit 75 is driven to display a low battery alarm on a low battery display 173. If the periodic information involves information on sensor failure, the display circuit 75 is driven to display a sensor failure on a sensor failure display 174.

On the other hand, when the periodic information is not normally received, the timer counter overflows after the periodic information time has passed. A periodic information abnormal signal is thus sent to the side of the fire receiver 100 through the information input/output circuit 86 on the basis of the overflow output. At the same time, the sensor failure display 174 is lighted by the display circuit 75 so as to inform sensor failure.

Although, in the embodiment shown in FIG. 7, the fire decision software is loaded on the fire receiver 100, the fire decision software may be loaded on the main device 14 so that the result of decision is sent to the fire receiver 100.

Although a receiver used only for the radio analog sensor of the present invention is used as the fire receiver 100, a composite device including a wire fire receiver in a wire analog fire alarm system and a radio receiver may be used.

Although, in the present invention, the receiver side is divided into the main device and the fire receiver, the receiver side may comprise a single radio fire receiver.

In addition, since sometimes radio waves do not reach the receiving side in a place where the radio analog sensor is installed, a repeater or a radio analog sensor having the function of a repeater is provided on the route of transmission.

What is claimed is:

1. A radio analog sensor comprising:

an analog sensor having circuits for detecting smoke density, temperature and the like in a noise environment having levels of noise;

an A/D converter for converting analog data transmitted from said analog sensor into digital data;

a storage memory for sampling a plurality of analog data converted by said A/D converter within a predetermined period and storing only data exceeding a predetermined noise level of said environment;

a data processing section for transmitting a plurality of said stored data when a presently-stored data has a predetermined change from a previously-stored data;

a battery power source for supplying power constantly to said circuits in said analog sensor;

a power control circuit for controlling the power supplied from said battery power source by switching said power source ON and OFF and supplying power when said data processing section transmits said stored data stored in said storage memory; and a transmission circuit for transmitting said stored data to a remote location when power is supplied in an ON controlling state of said power control circuit.

2. A radio analog sensor according to claim 1, wherein when said analog sensor detects temperature, said data processing section sends a plurality of analog signals stored in said storage memory when a rate of change with time of a present-detected temperature from a prior-detected temperature is greater than a predetermined value.

3. A radio analog sensor according to claim 1, wherein said analog data has integral values when said analog sensor detects smoke density, said data processing section sends a plurality of analog data stored in said storage memory when an integral value of the analog data exceeds a predetermined value.

4. A radio analog sensor according to claim 1, wherein said storage memory stores a predetermined number of analog data during a predetermined number of periods that have occurred, said transmission circuit transmitting a plurality of analog data stored during a predetermined number of periods in said storage memory when a presently-stored analog data has a predetermined change in value from a previously-stored analog data.

5. A radio analog sensor according to claim 1, wherein said radial analog smoke sensor comprises a periodic information circuit for transmitting predetermined periodic information to a remote location at predetermined intervals.

* * * * *